US007388337B2

(12) United States Patent
Takahasi et al.

(10) Patent No.: US 7,388,337 B2
(45) Date of Patent: Jun. 17, 2008

(54) FLUORESCENT LAMP LIGHTING APPARATUS AND LIGHTING CONTROL SYSTEM

(75) Inventors: Koji Takahasi, Yokosuka (JP); Toshiyuki Hiraoka, Numazu (JP); Noriyuki Kitamura, Hadano (JP); Naoko Iwai, Yokohama (JP); Kazuyuki Uratani, Tokyo (JP); Shinji Nogi, Tokyo (JP); Toru Ishikita, Yokosuka (JP); Isao Yamazaki, Tokyo (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 183 days.

(21) Appl. No.: 11/453,013

(22) Filed: Jun. 15, 2006

(65) Prior Publication Data

US 2007/0075650 A1 Apr. 5, 2007

(30) Foreign Application Priority Data

Sep. 30, 2005 (JP) ..... 2005-286585

(51) Int. Cl.
*H05B 37/02* (2006.01)

(52) U.S. Cl. ..... 315/224; 315/291; 315/306; 315/DIG. 4; 323/905

(58) Field of Classification Search ..... 315/224–226, 315/291, 307, 308, DIG. 4, DIG. 5, 209 R; 323/905

See application file for complete search history.

(56) References Cited

U.S. PATENT DOCUMENTS

| | | | | |
|---|---|---|---|---|
| 6,949,885 | B2 * | 9/2005 | Hamamoto et al. | 315/200 R |
| 7,176,635 | B2 * | 2/2007 | Gordin et al. | 315/226 |
| 2006/0158131 | A1 * | 7/2006 | Mitsuyasu et al. | 315/209 R |

FOREIGN PATENT DOCUMENTS

| | | | |
|---|---|---|---|
| JP | 64-89287 | | 4/1989 |
| JP | 2001-15276 | * | 1/2001 |

* cited by examiner

*Primary Examiner*—Thuy V. Tran
*Assistant Examiner*—Ephrem Alemu
(74) *Attorney, Agent, or Firm*—DLA Piper US LLP

(57) ABSTRACT

A fluorescent lamp lighting apparatus according to the present invention comprises an initial illuminance correction control circuit which sets a fluorescent lamp to an initial illuminance correction control lighting mode, a switching portion which changes the fluorescent lamp from the initial illuminance correction control lighting mode to an external control dimming mode when a predetermined external dimming signal is detected, and a control portion which gradually dimming so as to achieve a dimming level of a switched mode when switching the initial illuminance correction control lighting mode and the external control dimming mode, and control so as to achieve a dimming level corresponding to a cumulative lighting time of the fluorescent lamp when the changed mode is the initial illuminance correction control lighting mode.

6 Claims, 4 Drawing Sheets

FLUORESCENT LAMP LIGHTING APPARATUS AND LIGHTING CONTROL SYSTEM

CROSS-REFERENCE TO RELATED APPLICATIONS

This application is based upon and claims the benefit of priority from prior Japanese Patent Application No. 2005-286585, filed Sep. 30, 2005, the entire contents of which are incorporated herein by reference.

BACKGROUND OF THE INVENTION

1. Field of the Invention

The present invention relates to a fluorescent lamp lighting apparatus provided with an initial illuminance correction control circuit, and a lighting control system.

2. Description of the Related Art

A fluorescent lamp has properties that brightness is maximum in a lighting initial stage and then brightness is reduced with elapse of a lighting time. Such properties can be expressed as a light beam reduction curve. On the contrary, as a lighting target space, it is generally desirable to always perform lighting with a fixed illuminance even if lighting is carried out by using a fluorescent lamp. Thus, a dimming ratio is set to a value which is as small as possible to allow dark lightning in accordance with a reduction in a light beam involved by elapse of a lighting time from a lighting initial stage of a fluorescent lamp, and this dimming ratio is gradually increased with elapse of the time. As a result, there has been adopted a technique which controls lighting in a lighting target space with a fixed illuminance until an end of life duration of the fluorescent lamp. Such lighting control is referred to as initial illuminance correction control.

As described in, e.g., Jpn. Pat. Appln. KOKAI Publication No. 64-089287, the initial illuminance correction control is adopted in a lighting control scheme which first collectively controls an entire lighting target space. In this lighting control scheme, a common control device is installed separately from a plurality of lighting equipments, and the respective lighting equipments are connected with each other through a dedicated signal line or a signal line which also serves as a power supply line. Further, in the above-described lighting control scheme, fluorescent lamps in a lighting target space are concurrently subjected to the initial illuminance correction control by using a timer incorporated in the control device and table data in such a manner that a dimming level for each preset lighting elapse time can be achieved.

Furthermore, as a fluorescent lamp lighting apparatus, there is one which enables dimming and lighting based on external control. Such an apparatus includes a dimming control circuit. When an external dimming signal is supplied to the dimming control circuit, the dimming control circuit controls a high-frequency lighting circuit in accordance with the external dimming signal to adjust a high-frequency output which is supplied to a fluorescent lamp, thereby effecting dimming.

BRIEF SUMMARY OF THE INVENTION

It is, therefore, an object of the present invention to provide a fluorescent lamp lighting apparatus which can selectively set one of an initial illuminance correction control lighting mode and an external-control dimming mode at the time of installation or use, and a lighting control system.

That is, according to the present invention, there is provided a fluorescent lamp lighting apparatus comprising:

a high-frequency lighting circuit energizing a fluorescent lamp;

a dimming control circuit which controls the high-frequency lighting circuit to dim the fluorescent lamp;

an initial illuminance correction control circuit which controls the dimming control circuit to set an initial illuminance correction control lighting mode;

a switching means for changing the initial illuminance correction control lighting mode to an external control dimming mode, when a predetermined external dimming signal is detected;

a cumulative lighting time measuring means for accumulating a lighting time of the fluorescent lamp; and a controlling means for gradually dimming so as to achieve a dimming level of a switched mode when switching the initial illuminance correction control lighting mode and the external control dimming mode, and controlling so as to achieve a dimming level corresponding to a cumulative lighting time of the fluorescent lamp, when the changed mode is the initial illuminance correction control lighting mode.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments according to the present invention will now be described hereinafter with reference to the accompanying drawings.

First Embodiment

A first embodiment according to the present invention will be first explained.

Figure 1:
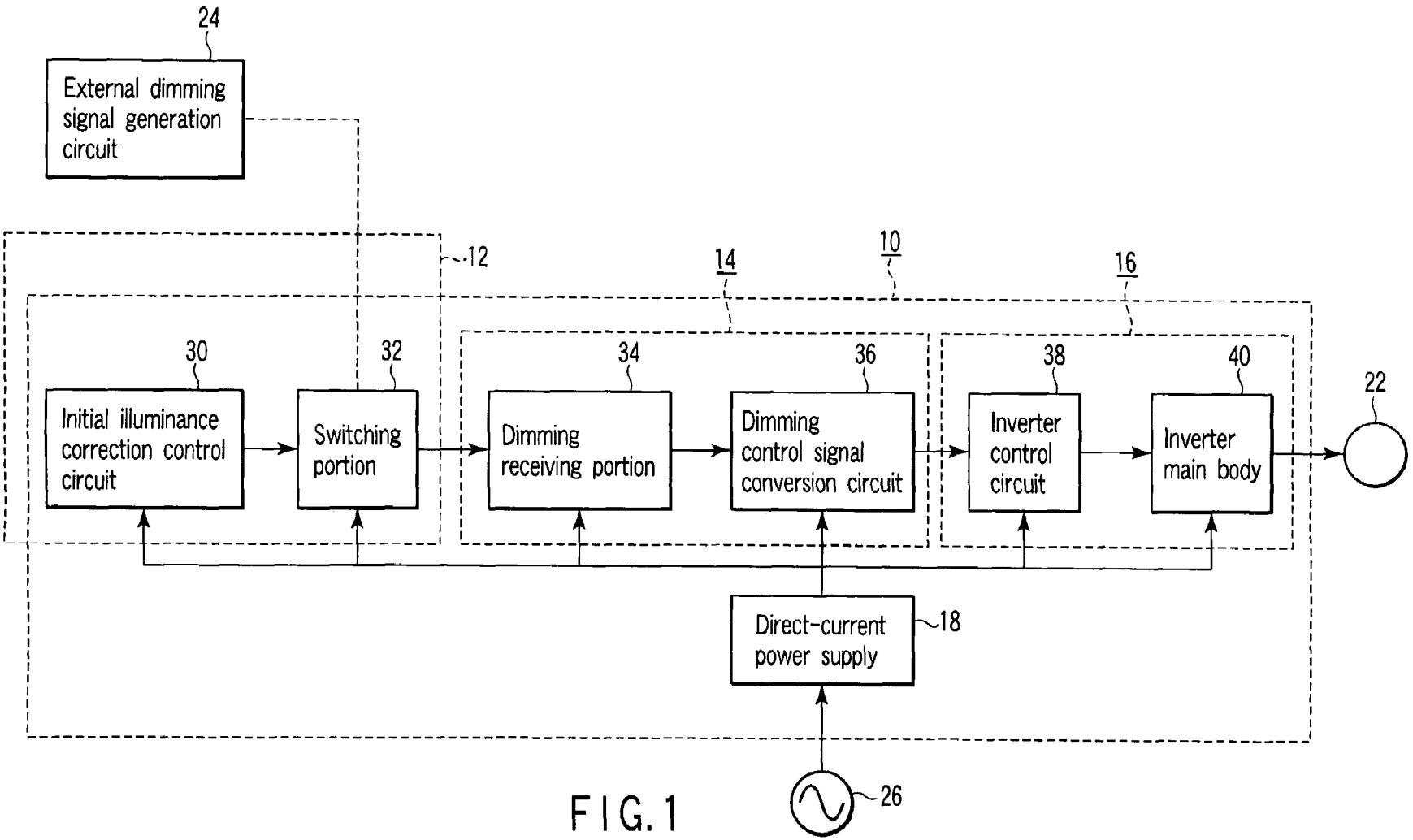
FIG. 1 is a circuit block diagram of a fluorescent lamp lighting apparatus showing a first embodiment of the present invention.

FIG. 1 is a circuit block diagram showing a fluorescent lamp lighting apparatus according to the first embodiment of the present invention. In this embodiment, a fluorescent lamp lighting apparatus 10 is configured to have a control portion 12, a dimming control circuit 14, a high-frequency lighting circuit 16 and a direct-current power supply 18. It is to be noted that reference numeral 22 denotes a fluorescent lamp; 24, an external dimming signal generation circuit; and 26, a low-frequency alternating-current power supply in the drawing.

The high-frequency lighting circuit 16 has an inverter main body 40 and an inverter control circuit 38. The inverter main body 40 is constituted of a half-bridge type inverter main circuit or the like. The inverter control circuit 38 is a circuit which mainly controls the inverter main body 40. For example, the inverter control circuit 38 drives the inverter main body 40 by supplying a driving signal subjected to frequency control to the inverter main body 40.

The dimming control circuit 14 is a circuit which generates a dimming control signal, controls and inputs this signal to the inverter control circuit 38 of the high-frequency lighting circuit 16 and changes a high-frequency output from the high-frequency lighting circuit 16 in accordance with the dimming control signal, and it is configured to have a dimming receiving portion 34 and a dimming control signal conversion circuit 36.

The dimming control circuit 14 is circuit means which controls the high-frequency lighting circuit 16 to change a high-frequency output from the high-frequency lighting circuit 16, thereby dimming a fluorescent lamp 22. For example, it is possible to selectively adopt a frequency control mode, a PWM control mode or the like. In the former mode, a frequency of a high-frequency voltage in the high-frequency lighting circuit is changed to control an impedance of current-limiting means, thereby dimming the fluorescent lamp 22. In the latter mode, a period in which a high-frequency output is output (on-duty) is changed to control an effective voltage, thus dimming the fluorescent lamp 22.

Further, the dimming control circuit 14 functions when the fluorescent lamp 22 is in both an initial illuminance correction control lighting mode and an external control dimming mode, and controls a lamp power to a necessary value which is used when the fluorescent lamp 22 is turned on.

When the fluorescent lamp 22 sets the initial illuminance correction control lighting mode to be lighted up, the dimming control circuit 14 is controlled by an initial illuminance correction control circuit 30. On the other hand, when the fluorescent lamp 22 sets the external control dimming mode to be lighted up, an external dimming signal is used to control the dimming control circuit 14 by the external dimming signal generation circuit 24.

The external dimming signal may be a dimming signal based on cable transmission or radio transmission or a dimming signal generated by an operation of a user of a dimming operating portion (not shown) provided to the fluorescent lamp lighting apparatus 10.

In case of the dimming signal based on cable transmission, one end of an external dimming line is connected with a dimming terminal of the fluorescent lamp lighting apparatus 10, and the other end of the same is connected with the external dimming signal generation circuit 24 such as a dimmer. Furthermore, a user operates this external dimming signal generation circuit 24 to form an external dimming signal, or an external dimming signal is automatically formed, and this signal is transmitted to the fluorescent lamp lighting apparatus 10 through the external dimming line. In the fluorescent lamp lighting apparatus 10, when the external dimming signal is supplied through the external dimming line, the dimming control circuit 14 controls an output of the high-frequency lighting circuit 16 in response to the supplied signal, whereby the fluorescent lamp 22 is energized to dimming.

On the other hand, in case of a dimming signal based on radio transmission, a carrier wave including infrared light, an ultrasonic wave or the like is modulated by using an external dimming signal to form an external dimming radio signal. A receiver for the external dimming radio signal is arranged in the fluorescent lamp lighting apparatus 10 to receive the external dimming radio signal. The received signal is demodulated to take out an external dimming signal, thereby controlling the dimming control circuit 14. Moreover, an output from the high-frequency lighting circuit 16 is dependently controlled to effect dimming of the fluorescent lamp 22.

In case of the external dimming signal generation circuit 24 additionally provided to the fluorescent lamp lighting apparatus 10, an external dimming signal is generated by operating the external dimming signal generation circuit 24 by a user. Additionally, this external dimming signal is directly controlled and input to the dimming control circuit 14 to control the dimming control circuit 14, and an output from the high-frequency lighting circuit 16 is dependently controlled, thereby effecting dimming of the fluorescent lamp 22.

In the fluorescent lamp 22, an initial light beam has a maximum value as described above, but this beam contrarily has a minimum value at the end of life duration, and the light beam is gradually reduced with elapse of a lighting time. The initial illuminance correction control circuit 30 is control circuit means which performs dimming with respect to the fluorescent lamp 22 while automatically sequentially increasing a dimming ratio in accordance with elapse of a lighting time of the fluorescent lamp 22 in such a manner that an illuminance becomes substantially fixed with a light beam smaller than an initial light beam, e.g., 70% of the initial light beam from a lighting initial stage of the fluorescent lamp. As a result, an initial illuminance of the fluorescent lamp 22 is suppressed, and an illuminance of the fluorescent lamp 22 is maintained substantially constant until the end of life duration irrespective of elapse of a lighting time.

For example, the initial illuminance correction control circuit 30 can be mainly constituted of a cumulative lighting time measuring portion, a memory and a program. The cumulative lighting time measuring portion is a timer which accumulates and measures a lighting time of the fluorescent lamp 22. Incidentally, in regard to the timer, the initial illuminance correction control circuit 30 can be constituted by using not only an individual device such as an IC but also by utilizing a timer function, a memory function and an arithmetic operation function of a microcomputer which controls the entire fluorescent lamp lighting apparatus.

Although a lighting time is a time during which the fluorescent lamp is lighted, but a warm-up time or the like in which the fluorescent lamp 22 is not lighted may be included in the actual measurement. That is because the warm-up time or the like is as very small as several milliseconds with respect to life duration of the lamp, e.g., 12000 hours. In short, as the cumulative lighting time measuring means, one which can measure an approximate time can suffice.

The memory stores a dimming level for each preset lighting time, and such a level can be read as needed. The program reads a predetermined dimming level from the memory in accordance with a lighting time, and controls and inputs the read level to the dimming control circuit 14. Further, the program is configured to reset the initial illuminance correction control circuit 30 to again effect the initial illuminance correction control from the beginning when the fluorescent lamp 22 is replaced with a new one. Resetting means may be constituted of, e.g., an operation switch.

The dimming receiving portion 34 receives a dimming signal supplied from the initial illuminance correction control circuit 30 or the external dimming signal generation circuit 24, and transmits the received signal to the dimming control signal conversion circuit 36. The dimming control signal conversion circuit 36 converts the transmitted dimming signal into a dimming control signal. It is to be noted that the dimming signal is formed of, e.g., a PWM control signal, and this signal is converted into a dimming control signal formed of, e.g., a direct-current level signal.

The initial illuminance correction control circuit 30 generates a dimming signal constituted of an initial illuminance correction signal corresponding to a light time, and transmits the generated signal to the dimming control circuit 14 through a later-described switching portion 32. Furthermore, the initial illuminance correction control circuit 30 is mainly constituted to have a timer function, a memory function, an arithmetic operation function and a program as cumulative lighting time measuring means of a microcomputer, and generates a dimming signal formed of an initial illuminance correction signal along a light beam reduction curve of the fluorescent lamp.

The initial illuminance correction control circuit 30 accumulates and measures a lighting time of the fluorescent lamp 22.

Moreover, the control portion 12 gradually performs dimming to achieve a dimming level in a switched mode when switching an initial illuminance correction control lighting mode and an external control dimming mode. Additionally, when the switched mode is the initial illuminance correction control lighting mode, the control portion 12 controls to achieve a dimming level corresponding to a cumulative lighting time of the fluorescent lamp. In a case where the fluorescent lamp is lighted in the external control dimming mode, configuring the control portion 12 to continuously perform measurement of a lighting time can reflect the initial illuminance correction control to be continued when the initial illuminance correction control lighting mode is restored.

In case of switching the lighting mode by utilizing an external dimming signal, desired one or more of the following configurations can be appropriately combined.

(1) The initial illuminance correction control circuit 30 is configured to control the dimming control circuit 14 when an external dimming signal is not supplied to the dimming terminal arranged in the fluorescent lamp lighting apparatus 10. Further, when the external dimming signal has reached the dimming terminal, the lighting mode is switched to the external control dimming mode. In accordance with this switching, the dimming control circuit 14 is controlled by using the external dimming signal to perform dimming and lighting of the fluorescent lamp 22, and the initial illuminance correction control circuit 30 is prevented from controlling the dimming control circuit 14.

(2) Switching to the external control dimming mode is configured to be enabled in both a state where the fluorescent lamp 22 is attached to an output terminal of the high-frequency lighting circuit 16 (a loaded state) and a state where the fluorescent lamp 22 is not attached (a no load state).

(3) A control microcomputer is arranged, and each of the initial illuminance correction control lighting mode and the external control dimming mode is stored with a flag in the microcomputer. As a result, the microcomputer can be configured to readily switch the initial illuminance correction control lighting mode and the external control dimming mode and perform lighting control.

(4) In order to assuredly enable identification of an external dimming signal even if a dimming ratio is small, the control microcomputer is set to recognize an external dimming signal when this signal is not smaller than a minimum level of an electrical signal which does not include "0" of the external dimming signal.

In a case where an external dimming signal is formed of an on-duty control signal as generally adopted, an electrical signal of the external dimming signal becomes a 0 level when the on-duty is reduced to 0%. This case of the external dimming signal is hard to be discriminated from a case where the external dimming signal does not exist. In such a case, identification of the external dimming signal is difficult, and hence the microcomputer is previously set to identify the minimum level or above where an electrical signal does not include "0" as the external dimming signal in this embodiment as described above.

In this embodiment, the control portion 12 includes the switching portion 32 which controls the dimming control circuit 14 to switch the fluorescent lamp 22 from the initial illuminance correction control lighting mode to the external control dimming mode when a predetermined external dimming signal is detected. The switching portion 32 monitors the external dimming signal transmitted through a transmission line connected with the external dimming signal generation circuit 24, detects arrival of the external dimming signal at the time of installation of the fluorescent lamp lighting apparatus 10, and switches the initial illuminance correction control circuit 30 to be inactivated. The switching portion 32 includes an external control dimming lighting control circuit (not shown) which controls the dimming control circuit 14 by using the external dimming signal.

The fluorescent lamp 22 is connected between output terminals of the high-frequency lighting circuit 16 to be energized to high-frequency lighting.

The external dimming signal generation circuit 24 is, e.g., a lighting control system which collectively performs initial illuminance correction control with respect to many fluorescent lamp lighting apparatuses 10 arranged in many lighting equipments to illuminate a lighting target space, or carries out dimming of a lighting target space to a necessary degree in accordance with each of a plurality of regions in this space while integrating the entire lighting target space.

The direct-current power supply 18 rectifies and smoothens a voltage of the low-frequency alternating-current power supply 26, and outputs a direct-current voltage. Furthermore, the direct-current power supply 18 supplies a direct-current power having a necessary voltage to the high-frequency lighting circuit 16, the dimming control circuit 14, the initial illuminance correction control circuit 30 and the switching portion 32.

Moreover, the initial illuminance correction control circuit 30 incorporated in the fluorescent lamp lighting apparatus 10 or the external dimming signal generation circuit 24 can be used to perform high-frequency lighting while effecting the initial illuminance correction control with respect to the fluorescent lamp 22.

Additionally, statuses of the initial illuminance correction control lighting mode and the external control dimming mode are stored by using flags in the microcomputer in advance. Further, when switching the lighting mode, a status flag is first checked to recognize a current lighting mode after initialization.

Figure 2:
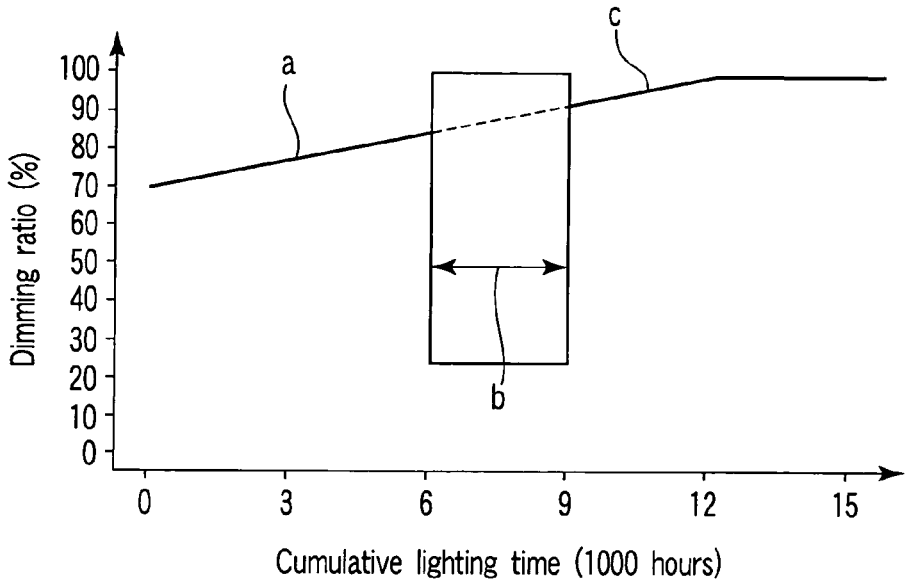
FIG. 2 is a graph illustrating functions of an initial illuminance correction control circuit in an initial illuminance correction control lighting mode and an external control dimming mode in life duration of a fluorescent lamp according to the first embodiment of the present invention.

FIG. 2 is a graph illustrating functions of the initial illuminance correction control circuit 30 in the initial illuminance correction control lighting mode and the external control dimming mode during life duration of the fluorescent lamp in order to carry out the fluorescent lamp lighting apparatus 10 according to the present invention. In FIG. 2, a horizontal axis represents a cumulative lighting time (1000 hours) and a vertical axis represents a dimming ratio (a dimming level) (%), respectively. In this embodiment, a time measuring function of the initial illuminance correction control circuit is configured to continue even in the external control dimming mode.

A description will now be given as to the this embodiment in which the fluorescent lamp 22 is turned on in the initial illuminance correction control lighting mode when the cumulative lighting time falls within a range of 0 to 6000 hours (a in the drawing), the same is turned on in the external control dimming mode when the cumulative lighting time falls within a range of 6000 to 9000 hours (b in the drawing) and the same is again turned on in the initial illuminance correction control lighting mode when the cumulative lighting time is above 9000 hours (c in the drawing).

In the fluorescent lamp lighting apparatus 10 shown in FIG. 1, when the fluorescent lamp 22 is turned on in the initial illuminance correction control lighting mode, the initial illuminance correction control circuit 30 controls the dimming control circuit 14. Therefore, the fluorescent lamp 22 is turned on with a dimming ratio of 70% when the cumulative lighting time is 0, and then lighting is carried out while the dimming ratio is gradually increased with an increase in the cumulative lighting time. Therefore, an illuminance of the fluorescent lamp 22 is maintained constant until the cumulative lighting time reaches 6000 hours.

It is assumed that the lighting mode of the fluorescent lamp 22 is switched to the external control dimming mode when the cumulative lighting time reaches 6000 hours. As a result, the dimming control circuit 14 is controlled based on an external dimming signal transmitted from the external dimming signal generation circuit 24.

When the external control dimming mode is achieved, the fluorescent lamp 22 can be lighted until the dimming ratio on the maximum level (an upper limit value) reaches 100%. In other words, during the external control dimming mode, the initial illuminance correction control is not carried out. However, the initial illuminance correction control circuit 30 continues measurement of the cumulative lighting time even in a period of the external control dimming mode. Further, a lower limit value of the dimming level, e.g., 25% with which the fluorescent lamp lighting apparatus 10 can dim of the fluorescent lamp 20 is set as a dimming ratio on the minimum level. The fluorescent lamp 22 is lighted in a range of the dimming ratio from 25% to 100% in accordance with an external dimming signal.

Furthermore, it is assumed that the initial illuminance correction control lighting mode is restored when the cumulative lighting time of the fluorescent lamp 22 is 9000 hours. In this case, the initial illuminance correction control circuit 30 controls the dimming control circuit 14 in order to achieve a dimming ratio (92.5%) as the cumulative lighting time of 9000 hours.

As a result, the initial illuminance correction control is effected in a way that lighting has been continuously carried out in the initial illuminance correction control lighting mode from 0 to 9000 hours of the cumulative lighting time. Therefore, the illuminance (brightness) is maintained constant during lighting of the fluorescent lamp 22 in the initial illuminance correction control lighting mode.

Figure 3:
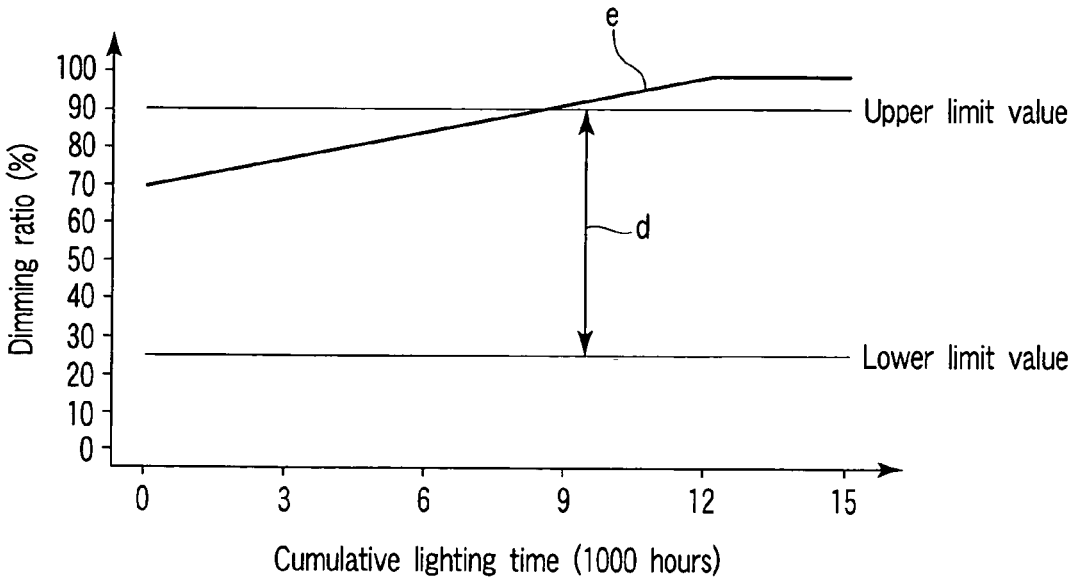
FIG. 3 is a graph illustrating operations of controlling means in the initial illuminance correction control lighting mode and the external control dimming mode during life duration of the fluorescent lamp according to the first embodiment of the present invention.

Moreover, FIG. 3 is a graph illustrating operations of the control portion 12 in the initial illuminance correction control lighting mode and the external control dimming mode during life duration of the fluorescent lamp in order to embody the fluorescent lamp lighting apparatus 10 according to the present invention.

In the external control dimming mode (d in the drawing), a dimming ratio as an upper limit value of the fluorescent lamp 22 is set to 90%. Even if an external dimming signal exceeding this value is input, the control portion 12 performs lighting and control of the fluorescent lamp 22 with the dimming ratio of 90%. The fluorescent lamp 22 is lighted with the dimming ratio of 90% as the upper limit value and the dimming ratio of 20% as a lower limit value in accordance with the external dimming signal. Lighting the fluorescent lamp 22 with the dimming ratio of 90% as the upper limit value or below can prevent the illumination from having excessive brightness and reduce power consumption of the fluorescent lamp lighting apparatus, thus realizing electric power saving.

Additionally, the external control dimming mode (d in the drawing) can be freely switched to the initial illuminance correction control lighting mode (e in the drawing), and an initial illuminance can be obtained in the initial illuminance correction control lighting mode after switching.

According to the present invention, since the initial illuminance correction control lighting mode and the external control dimming mode are switched based on the external signal, the switching can be carried out irrespective of before and after installation of equipments.

It is to be noted that, when the external dimming signal is used as an external signal, a dimmer is arranged on, e.g., a wall surface and the dimmer is connected with the dimming terminal of the fluorescent lamp lighting apparatus 10 through an external dimming line. When the dimmer is operated, the control microcomputer detects supply of the external dimming signal to the dimming control circuit 14 through the external dimming line and controls the initial illuminance correction control circuit 30 to not function. Therefore, the control microcomputer functions as switching means to switch the initial illuminance correction control lighting mode to the external control dimming mode. Therefore, after installation of the fluorescent lamp lighting apparatus 10, when the fluorescent lamp lighting apparatus 10 does not detect the external dimming signal, the initial illuminance correction control circuit 30 automatically operates to effect the initial illuminance correction control in the fluorescent lamp lighting apparatus alone.

Furthermore, the upper limit value is previously set and stored in a memory (not shown) of the control portion 12. Moreover, an external setting portion may be provided to arbitrarily set an upper limit value from the outside, and the set value may be set in the memory.

When the lighting control of the fluorescent lamp 22 is in the external control dimming mode, the control portion 12 performs lighting of the fluorescent lamp 22 with the dimming level as the upper limit value even though an external dimming signal which is used to effect lighting of the fluorescent lamp 22 beyond the dimming level as the upper limit value is input (detected). A lower limit value of the dimming level is determined by the high-frequency lighting circuit 16 which carries out dimming and lighting of the fluorescent lamp 22.

Second Embodiment

A second embodiment according to the present invention will now be described.

Figure 4:
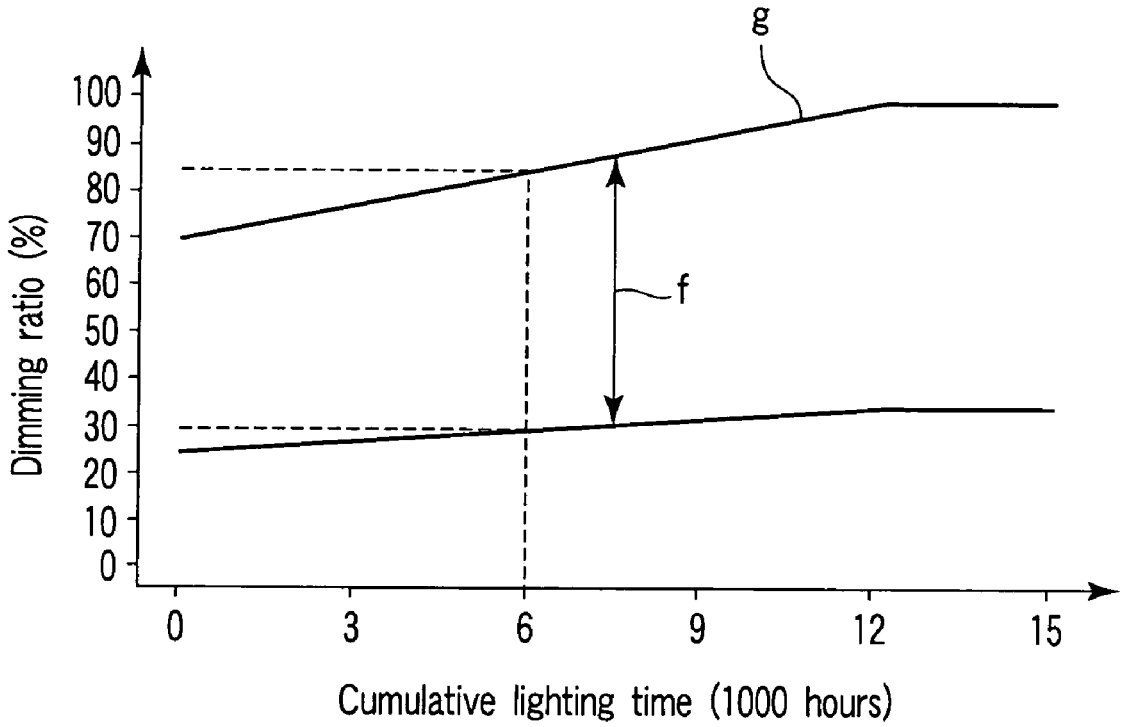
FIG. 4 is a graph illustrating operations of controlling means of a fluorescent lamp lighting apparatus in the external control dimming mode according to a second embodiment of the present invention.

FIG. 4 is a graph illustrating operations of a control portion 12 in an external control dimming mode of a fluorescent lamp lighting apparatus 10 according to the second embodiment of the present invention.

In the external control dimming mode (f in the drawing), a dimming ratio (a dimming level) as an upper limit value of a fluorescent lamp 22 is set to a dimming ratio (the dimming level) corresponding to a cumulative lighting time of the fluorescent lamp 22 in an initial illuminance correction control lighting mode (g in the drawing). That is, the dimming ratio as the upper limit value is increased to 70% to 100% with respect to a cumulative lighting time of 0 to 12000 hours. Further, the dimming ratio as a lower limit value is also increased to 25% to 35% with respect to the cumulative lighting time of 0 to 12000 hours. For example, in case of a cumulative lighting time which is 6000 hours, the dimming ratio as the upper limit value is 85%, and the dimming ratio as the lower limit value is 30%. In this manner, the upper limit value and the lower limit value of the dimming ratio of the fluorescent lamp 22 vary in accordance with a cumulative lighting time of the fluorescent lamp 22.

When the fluorescent lamp 22 is lighted with a fixed dimming ratio, its light beam is gradually reduced in accordance with a cumulative lighting time. Since the upper limit value of the dimming ratio is increased in accordance with a cumulative lighting time, a reduction in the light beam can be corrected by increasing the dimming ratio by using an external dimming signal. Moreover, the fluorescent lamp 22 is subjected to dimming and lighting with the dimming ratio as the increased upper limit value or below. Therefore, necessary brightness of the illumination can be obtained while achieving electric power saving of the fluorescent lamp lighting apparatus 10.

Third Embodiment

A third embodiment according to the present invention will now be described.

Figure 5:
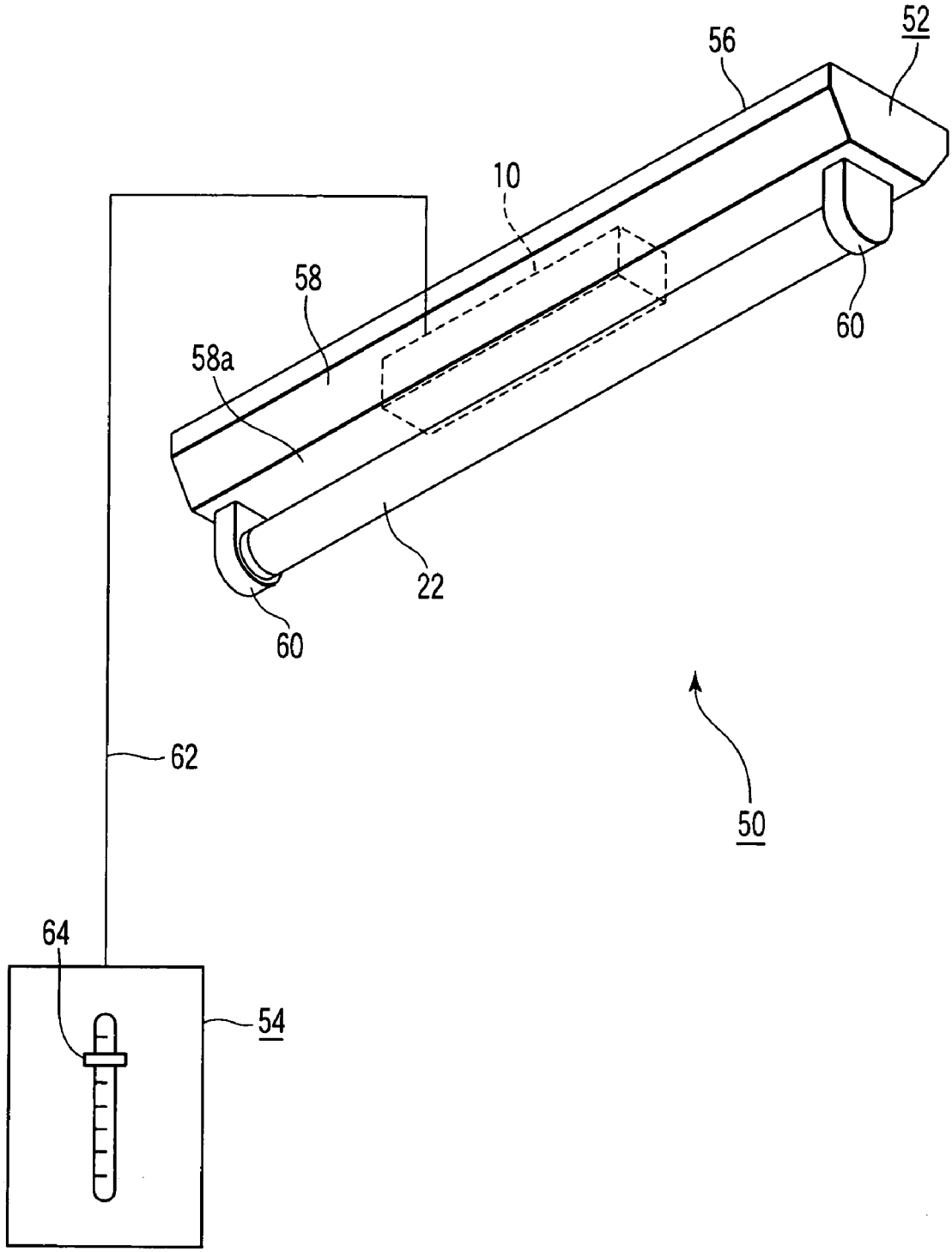
FIG. 5 is a schematic block diagram showing a lighting control system according to a third embodiment of the present invention.

FIG. 5 is a schematic block diagram showing a lighting control system according to a third embodiment of the present invention. It is to be noted that like reference numerals denote parts equal to those in FIG. 1, thereby eliminating their explanation.

The lighting control system 50 shown in FIG. 5 is configured to have a fluorescent lamp lighting apparatus 10, a lighting equipment 52 and a dimmer 54.

The lighting equipment 52 is a direct-mount lighting equipment which is arranged on a construction matter such as a ceiling. In an equipment main body 56, a cover 58 having a reflecting surface 58*a* is arranged, and a pair of lamp sockets 60 and 60 are provided at both ends. Further, in the equipment main body 56, the fluorescent lamp lighting apparatus 10 is arranged in the cover 58. A fluorescent lamp 22 is attached to the lamp sockets 60 and 60.

In the fluorescent lamp lighting apparatus 10, a switching portion 32 is connected with a dimming apparatus (the dimmer) 54 through an external dimming line 62 as a signal line. An external dimming signal generation circuit 24 is provided in the dimming apparatus 54.

When an external operator 64 of the dimming apparatus 54 is moved, an external dimming signal is output from the external dimming signal generation circuit 24 and input to the fluorescent lamp lighting apparatus 10. The fluorescent lamp lighting apparatus 10 lights the fluorescent lamp 22 in an external control dimming mode. The fluorescent lamp 22 is lighted with a dimming ratio corresponding to the external dimming signal within a range of an upper limit value and a lower limit value of the dimming ratio.

Furthermore, when the external operator 64 of the dimming apparatus 54 is moved to an uppermost part, the external dimming signal is no longer output from the external dimming signal generation circuit 24. The fluorescent lamp lighting apparatus 10 lights the fluorescent lamp 22 in an initial illuminance correction control lighting mode and maintains an illuminance constant. In this manner, moving the external operator 64 of the dimming apparatus 54 switches the external control dimming mode and the initial illuminance correction control lighting mode.

Although the above has described the embodiments according to the present invention, the present invention is not restricted to the foregoing embodiments, and various modifications can be of course carried out without departing from the scope of the invention.

Moreover, the foregoing embodiments include inventions on various stages, and appropriately combining a plurality of disclosed constituent requirements can extract various inventions. For example, even if some constituent requirements are eliminated from all constituent requirements disclosed in the embodiments, the problems described in the section "Problems to be Solved by the Invention" can be solved. When the effects described in the section "Effects of the Invention" can be obtained, the structure in which the constituent requirements are eliminated can be also extracted as an invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A fluorescent lamp lighting apparatus comprising:

a high-frequency lighting circuit energizing a fluorescent lamp;

a dimming control circuit which controls the high-frequency lighting circuit to dim the fluorescent lamp; and a control portion including:

an initial illuminance correction control circuit which controls the dimming control circuit to set an initial illuminance correction control lighting mode, a switching means for changing the initial illuminance correction control lighting mode to an external control dimming mode, when a predetermined external dimming signal is detected, and a cumulative lighting time measuring means for accumulating a lighting time of the fluorescent lamp, the control portion gradually dimming so as to achieve a dimming level of a switched mode when switching the initial illuminance correction control lighting mode to the external control dimming mode, and controlling so as to achieve a dimming level corresponding to a cumulative lighting time of the fluorescent lamp during the initial illuminance correction control lighting mode.

2. The fluorescent lamp lighting apparatus according to claim 1, wherein the control portion controls the dimming control circuit to achieve a dimming level corresponding to a cumulative lighting time of the fluorescent lamp when a mode is the initial illuminance correction control lighting mode, and controls the dimming control circuit to achieve a dimming level corresponding to an external dimming signal which is not greater than a dimming level, as a dimming level corresponding to accumulative lighting time of the fluorescent lamp in the initial illuminance correction control lighting mode when a mode is the external control dimming mode.

3. A lighting control system comprising:

a fluorescent lamp lighting apparatus defined in claim 1;

a lighting equipment including the fluorescent lamp lighting apparatus and a fluorescent lamp energized by the fluorescent lamp lighting apparatus; and a dimming apparatus which transmits an external dimming signal to the fluorescent lamp lighting apparatus through a signal line.

4. The lighting control system according to claim 3, wherein the control portion controls the dimming control circuit to achieve a dimming level corresponding to a cumulative lighting time of the fluorescent lamp when a mode is the initial illuminance correction control lighting mode, and controls the dimming control circuit to achieve a dimming level corresponding to an external dimming signal which is not greater than a dimming level, as a dimming level corresponding to a cumulative lighting time of the fluorescent lamp in the initial illuminance correction control lighting mode when a mode is the external control dimming mode.

5. A fluorescent lamp lighting apparatus comprising:

a high-frequency lighting circuit energizing a fluorescent lamp;

a dimming control circuit which controls the high-frequency lighting circuit to dim the fluorescent lamp; and a control portion which accumulates a lighting time of the fluorescent lamp, detects a predetermined external dimming signal, controls the dimming control circuit to switch the fluorescent lamp from an initial illuminance correction control lighting mode to an external control dimming mode, gradually dimming to achieve a dimming level of the switched mode, and carries out control to achieve a dimming level corresponding to a cumulative lighting time of the fluorescent lamp during the initial illuminance correction control lighting mode.

6. The fluorescent lamp lighting apparatus according to claim 5, wherein the control portion controls the dimming control circuit to achieve a dimming level corresponding to a cumulative lighting time of the fluorescent lamp when a mode is the initial illuminance correction control lighting mode, and controls the dimming control circuit to achieve a dimming level corresponding to an external dimming signal which is not greater than a dimming level, as a dimming level corresponding to a cumulative lighting time of the fluorescent lamp in the initial illuminance correction control lighting mode when a mode is the external control dimming mode.

* * * * *